United States Patent [19]

Sayles

[11] 4,023,352

[45] May 17, 1977

[54] HIGH NITROGEN CONTENT GAS GENERANT AND METHOD OF PRODUCING NEAR-NEUTRAL COMBUSTION PRODUCTS

[75] Inventor: David C. Sayles, Huntsville, Ala.

[73] Assignee: The United States of America as represented by the Secretary of the Army, Washington, D.C.

[22] Filed: Mar. 26, 1974

[21] Appl. No.: 456,571

[52] U.S. Cl. ..... 60/218; 23/281; 60/219; 149/36

[51] Int. Cl.[2] ..... C06D 5/04

[58] Field of Search ..... 149/36; 60/218, 219; 23/281

[56] References Cited

UNITED STATES PATENTS

| | | | |
|---|---|---|---|
| 3,420,137 | 1/1969 | Staba | 86/1 R |
| 3,797,238 | 3/1974 | Iwanciow et al. | 60/219 |

OTHER PUBLICATIONS

Chem. Abs., "Seventh Collective Subject Index", p. 22,389S, (1970).

Yamamoto, *Chem. Abs.*, 61, abs. No. 11839b, (1964).

Mizushima et al., *Chem. Abs.*, 60, abs. No. 11838f, (1964).

Yoffe, *Chem. Abs.*, 46, abs. No. 5845b, (1952).

Okazaki, *Chem. Abs.*, 60, abs. No. 1528b, (1964).

Kikuchi, *Chem. Abs.*, 51, abs. No. 18612h, (1957).

*Primary Examiner*—Edward A. Miller

*Attorney, Agent, or Firm*—Nathan Edelberg; Robert P. Gibson; Jack W. Voigt

[57] ABSTRACT

Tetracene, $H_2N.C(:NH).NH.NH.N:N.C(:NH).NH.NH.NO$ ($C_2H_8N_{10}O$), that is pelletized by dead pressing at 10,000–30,000 psia is employed as a preferred gas generant for near-neutral combustion products. The chemical, tetracene, is almost completely nitrogen-containing, and has only negligible amounts of carbon or oxygen which results in producing dominant combustion products of nitrogen. Tetracene is employed as a gas generant in a method which produces near-neutral combustion products that are compatible with a variety of oxidizers (e.g., IRFNA, $ClF_3$, $ClF_5$, etc.) and a variety of fuels (e.g., UDMH, MHF, etc.). Contact of the combustion products with the oxidizers or fuels does not interfere with their normal functioning.

4 Claims, No Drawings

HIGH NITROGEN CONTENT GAS GENERANT AND METHOD OF PRODUCING NEAR-NEUTRAL COMBUSTION PRODUCTS

DEDICATORY CLAUSE

The invention described herein may be manufactured, used, and licensed by or for the Government for governmental purposes without the payment to me of any royalties thereon.

BACKGROUND OF THE INVENTION

Gas generants are employed as a means for producing a source of power for performing a variety of functions. An important function in liquid rocket systems or hybrid rocket sytems is the pressurizing or expelling of liquids from tanks. The well known reactive oxidizer, IRFNA (inhibited red fuming nitric acid) has been employed with the liquid fuel UDMH (unsymetrical dimethylhydrazine) in a liquid rocket system. The IRFNA is expelled from a storage tank in a controlled ratio with the fuel UDMH at a controlled ratio to produce a hypergolic reaction which provides propulsion gases for propelling a rocket that is fitted with an exhaust nozzle and the other necessary fixtures and controls.

The prior art has employed nitrogen gas as the pressurizing media; however, this requires maintaining a pressurized system or a liquid nitrogen system which adds complexity as well as increased weight as a result of required storage tanks and equipment to utilize this type pressurizing media.

If the pressurizing media is reactive with the liquid being expelled then a piston system or a diaphragm arrangement to provide the necessary separation between the media and liquid is required. A failure of either the piston or diaphragm could cause failure of the system from subsequent reactions resulting from contact of the media with the liquid.

A self-generating gas-pressurization system which employs sodium azide as the gas source has been utilized with some degree of success. An undesirable feature of the sodium azide as a gas generant is the high percentage of byproducts which results. The byproducts include about 35% metallic sodium and sodium salts which require separation. Separation can be effected through their injection through a swirltype injector into a cycloidal hollow chamber. The heavy constituents of the decomposition products are thrown outward by centrifugal action. Starting of the decomposition of the sodium azide is done by means of a slug of IRFNA.

The pressurizing media is required to be non-reactive with the IRFNA if there is likelihood of contact between it and the IRFNA. Thus, the requirement for separation of the solid media from the azide reaction, which would interfere with the normal functioning of the pressurizing system, increases complexity.

Desirable is a self-generating gas pressurizing system which produces a neutral gas or a non-reactive gas which, if brought into contact with IRFNA, would not interfere with normal functioning of the oxidizer or fuel.

Therefore, an object of this invention is to provide a high nitrogen-containing compound for use as a gas generant.

Another object of this invention is to provide a method of producing near-neutral combustion products, substantially free of particulate matter, which serve as the expulsion media for a reactive oxidizer, such as, IRFNA, from its storage tank.

A further object of this invention is to provide a method of producing near-neutral combustion products which can be employed without further treatment in a control system for thrust vector purposes.

SUMMARY OF THE INVENTION

Tetracene is pelletized for use as a gas generant by dead pressing at 10,000–30,000 psia. These pellets are placed in a porous metal cage. The porous metal cage allows the combustion products to escape while retaining the gas generant for continued reaction. When a slug of IRFNA is brough in contact with the pelletized tetracene, decomposition is initiated to yield near-neutral combustion products comprised substantially of nitrogen and carbon. The combustion products may be used without further treatment unless smokelessness is a requirement of the gas generant, then the less than 13% carbon can be separated to reduce smokiness. Separation of the carbon is effected through their injector through a swirl-type injector into a cycloidal hollow chamber where the carbon constituent is thrown outward by centrifugal action.

The pelletized form of tetracene provides a dense gas generant which yields near-neutral combustion products that are substantially free of particulate matter. The near-neutral combustion products, substantially free of particulate matter, is usable without further treatment unless less smokiness is required as noted.

DESCRIPTION OF THE PREFERRED EMBODIMENT

Tetracene in a pelletized form made by application by dead pressing at 10,000–30,000 psia is decomposed when IRFNA is brought into contact with the pellets.

Tetracene can be prepared from aminoguanidine dinitrate, sodium nitrate, and acetic acid, as described by Reckenback and Burton, Army Ordnance 12, 120 (1931). The empirical formula is $C_2H_8N_{10}O$, and the structural formula is: $H_2N{\cdot}C(:NH){\cdot}NH{\cdot}NH{\cdot}N{:}N{\cdot}C(:NH){\cdot}NH{\cdot}NH{\cdot}NO$. Tetracene is also referred to as 4,9bis-(imino)-1,2,3,5,6,7,8,10-octaaza-1-oxo-5-decene under the Rules of Nomenclature established by the International Union of Pure and Applied Chemistry.

When comparing tetracene to the prior art gas generant, sodium azide, the following facts are revealed. The maximum theoretical amount of nitrogen which would be produced by sodium azide is 64.5% wherein tetracene produces 74.2% of nitrogen, and total gas generant of 83.4%. The gas volume formed by sodium azide under standard conditions is 1032 cc/gm., whereas tetracene forms 1190 cc/gm. Thus, tetracene is a gas generant which produces a greater quantity of gases and a higher quality of gases for its intended use.

The tetracene pellets when placed in a porous metal cage remain in a stable form unitl it is desired to generate a near-neutral gas at which time a slug of IRFNA is brought into contact with the pellets which undergo decomposition. Since the gas is substantially nearneutral, it may be in direct contact with the IRFNA without forming reaction products which may interfere with the normal functions of a pressurization system.

The tetracene pellants can be packed in a container which can be placed in an on-board gas generator compartment which is provided with means for directing the gases to a control system for vector purposes. The initiation of decomposition can be accomplished just prior to the time that a pressurizing function is required. Because of the high yield of the inert gas volume, 1190 cc/gm, the weight burden for a rocket or space vehicle would be greatly reduced as compared to a compressed gas source or a liquefied gas system and the necessary auxillary equipment required to render the gas source usable. The problem of equipment or storage tank failure would not be a factor for the tetrazene system wherein the gas generant supplies the near-neutral gas at the time required by prior contact with a slug of IRFNA or an equivalent strong-oxidizing chemical to initiate the decomposition.

I claim:

1. A gas generant that is decomposable by a reaction initiated by contacting said gas generant with inhibited red fuming nitric acid to yield near-neutral combustion products comprised substantially of nitrogen and carbon, said gas generant consisting of tetracene

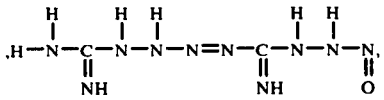

that is in a pelletized form prepared by dead pressing at 10,000–30,000 psia.

2. A method of producing near-neutral combustion products comprising:

i. providing pellets of tetracene;

ii. placing said pellets of tetracene is a porous metal cage for retaining said pellets of tetracene during a subsequent decomposition reaction which forms combustion products and for allowing the combustion products to escape from said cage; and, iii. contacting said pellets of tetracene with inhibited red fuming nitric acid to inititate decomposition reaction of said pellets of tetracene to yield near-neutral combustion products comprised substantially of nitrogen and carbon.

3. The method of claim 2 wherein said tetracene is pelletized by dead pressing at 10,000–30,000 psia.

4. The method of claim 3 wherein said carbon is separated from said near-neutral combustion products to reduce the smokiness and the particulate matter thereof.

* * * * *